US011986103B1

(12) United States Patent
Li

(10) Patent No.: US 11,986,103 B1
(45) Date of Patent: May 21, 2024

(54) PORTABLE FOLDING CHAIR

(71) Applicant: Dongsheng Li, Shenzhen (CN)

(72) Inventor: Dongsheng Li, Shenzhen (CN)

( * ) Notice: Subject to any disclaimer, the term of this patent is extended or adjusted under 35 U.S.C. 154(b) by 0 days.

(21) Appl. No.: 18/501,575

(22) Filed: Nov. 3, 2023

(51) Int. Cl.

| | |
|---|---|
| ***A47C 4/28*** | (2006.01) |
| ***A47C 3/40*** | (2006.01) |
| ***A47C 4/02*** | (2006.01) |
| ***A47C 4/20*** | (2006.01) |
| ***A47C 4/30*** | (2006.01) |
| ***A47C 4/34*** | (2006.01) |
| ***A47C 4/44*** | (2006.01) |
| ***A47C 9/10*** | (2006.01) |

(52) U.S. Cl.
CPC ..... *A47C 9/105* (2013.01); *A47C 3/40* (2013.01); *A47C 4/028* (2013.01); *A47C 4/20* (2013.01); *A47C 4/286* (2013.01); *A47C 4/30* (2013.01); *A47C 4/34* (2013.01); *A47C 4/44* (2013.01)

(58) Field of Classification Search
CPC ..... A47C 9/105; A47C 3/40; A47C 4/028; A47C 4/20; A47C 4/286; A47C 4/30; A47C 4/34; A47C 4/44
See application file for complete search history.

(56) References Cited

U.S. PATENT DOCUMENTS

| | | | | |
|---|---|---|---|---|
| 3,709,167 | A | 1/1973 | Sprigman | |
| 3,745,937 | A * | 7/1973 | Gail | A47C 5/10 248/435 |
| 4,317,552 | A * | 3/1982 | Weidler | F16M 13/00 248/168 |
| 6,125,769 | A * | 10/2000 | Tsai | A47B 3/002 297/16.2 |
| 6,820,845 | B2 * | 11/2004 | Nakatani | F16M 11/16 248/177.1 |
| 9,402,467 | B2 * | 8/2016 | Baoqing | A47B 3/002 |
| 9,854,914 | B2 | 1/2018 | Yoo | |
| 10,010,179 | B1 * | 7/2018 | Stump | A47C 4/44 |
| 10,194,751 | B1 * | 2/2019 | Frankel | A47C 9/105 |
| 10,612,719 | B2 * | 4/2020 | Li | F16M 11/245 |
| 11,439,238 | B1 | 9/2022 | Wang | |
| 11,700,943 | B1 | 7/2023 | Wang | |
| 11,786,041 | B1 * | 10/2023 | Chen | A47C 9/105 297/16.1 |
| 11,800,931 | B1 * | 10/2023 | Wu | A47C 4/286 |
| 11,844,439 | B1 * | 12/2023 | Wang | A47C 3/40 |
| 2003/0167980 | A1 * | 9/2003 | Suzuki | A47C 4/20 108/133 |

(Continued)

*Primary Examiner* — Robert Canfield

(57) ABSTRACT

Provided is a portable folding chair, comprising a supporting frame and a cloth cover cushion, wherein the supporting frame comprises a fixed seat, supporting legs rotatably connected to the fixed seat, and a supporting assembly connected to the supporting legs, a plurality of limiting plates and lugs positioned at two sides of the limiting plates are provided on a periphery of the fixed seat, and an accommodating groove for mounting the supporting leg is formed between the limiting plate and the lug. According to the present utility model, the supporting legs are prevented from being unfolded at an excessive angle, it is effectively guaranteed that the supporting legs will not shake on the fixed seat when the portable folding chair is used by a user, and the portable folding chair is effectively prevented from falling due to shaking of the supporting legs when placed on uneven ground.

9 Claims, 9 Drawing Sheets

(56) References Cited

U.S. PATENT DOCUMENTS

| | | | | |
|---|---|---|---|---|
| 2004/0245810 | A1 | 12/2004 | Tseng | |
| 2009/0174232 | A1* | 7/2009 | Hoffman | A47C 4/42 108/115 |
| 2017/0181548 | A1* | 6/2017 | Yoo | A47C 4/30 |
| 2020/0329873 | A1* | 10/2020 | Sun | A47C 3/40 |
| 2022/0386779 | A1* | 12/2022 | Garcia | A47C 4/286 |
| 2023/0023969 | A1 | 1/2023 | Zhu et al. | |
| 2023/0172358 | A1* | 6/2023 | Xu | A47C 9/105 297/16.2 |
| 2023/0200539 | A1* | 6/2023 | Chen | A47C 3/18 297/47 |
| 2023/0371693 | A1* | 11/2023 | Kim | A47C 7/002 |

* cited by examiner

PORTABLE FOLDING CHAIR

TECHNICAL FIELD

The present utility model relates to the field of chairs, and in particular, to a portable folding chair.

BACKGROUND

Portable folding chairs are lightweight, foldable and easy to carry, and are widely applied to various public places, such as hospitals, restaurants, hotels, and companies. Folding outdoor chairs, as the name suggests, are portable folding chairs that are easy to use outdoors. In the conventional technology, when the supporting legs of the portable folding chair are connected to a fixed seat, two sides of the fixed seat lack position limits on the supporting legs; when a user sits on a cloth cover cushion, the supporting legs shake easily on the fixed seat, and the user also shakes easily when sitting on the cloth cover cushion; consequently, the portable folding chairs are prone to falling over when the ground is uneven, making them unsafe to use.

Therefore, it is necessary to provide a portable folding chair to solve the foregoing technical problems.

SUMMARY

The present utility model provides a portable folding chair, which solves the problems that a fixed seat of the portable folding chair in the prior art lacks position limits on two sides of a supporting leg, the supporting leg is easy to shake on the fixed seat, and the portable folding chair is easy to fall over when the ground is uneven and then becomes unsafe to use.

In order to solve the foregoing technical problems, a technical solution of the present utility model is that: a portable folding chair comprises: a supporting frame and a cloth cover cushion detachably connected to the supporting frame, wherein the supporting frame comprises a fixed seat, a plurality of supporting legs rotatably connected to the fixed seat and a supporting assembly rotatably connected to the supporting legs and configured to support the cloth cover cushion, a plurality of limiting plates and lugs positioned at two sides of the limiting plates are provided on a periphery of the fixed seat, an accommodating groove for mounting the supporting leg is formed between the limiting plate and the lug, the supporting leg is rotatably connected in the accommodating groove, a front end of the supporting leg is provided with a guide surface matched with the limiting plate, when the supporting legs are unfolded and connected to the fixed seat, the guide surface is attached to the limiting plate, and two sides of the guide surface are separately attached to the lug.

In the present utility model, a positioning through hole is provided on the limiting plate, a positioning protrusion is provided at a position that is of the supporting leg and that is opposite to the positioning through hole, and when the supporting frame is unfolded, the positioning protrusion is positioned in the positioning through hole.

In the present utility model, the fixed seat is further provided with a first rotating shaft connected to the lug, and the supporting leg is connected to the first rotating shaft; and a torsion spring is provided on the first rotating shaft, and two ends of the torsion spring are respectively connected to the supporting leg and the limiting plate.

In the present utility model, the limiting plate is arranged obliquely, and the guide surface is an inclined surface matched with the limiting plate.

In the present utility model, a cylinder that is hollow and passes through the fixed seat is provided at a bottom of the fixed seat, and a periphery of the cylinder is provided with a plurality of reinforcing plates connected to a side wall of the fixed seat.

In the present utility model, the supporting assembly comprises a plurality of first supporting rods and a plurality of second supporting rods rotatably that are separately connected to the supporting legs, and the second supporting rod has a length greater than that of the first supporting rod.

In the present utility model, the first supporting rod and the second supporting rod are both telescopically arranged.

In the present utility model, the supporting legs are provided with through grooves for placing the first supporting rod and the second supporting rod.

In the present utility model, a bottom of the supporting leg is provided with an anti-skid rubber sleeve.

In the present utility model, the lug and the fixed seat are integrally formed.

Compared with the prior art, the present utility model has the following beneficial effects: when the portable folding chair of the present utility model is unfolded by the supporting legs, the guide surfaces of the supporting legs are attached to the limiting plates, and the limiting plates limit the supporting legs, so that the supporting legs are prevented from being unfolded at an excessive angle; and in addition, after the limiting plates are attached to the guide surfaces of the supporting legs, two sides of the supporting legs are attached to the lugs, it is effectively guaranteed that the supporting legs will not shake on the fixed seat when the portable folding chair is used by a user, and the portable folding chair is effectively prevented from falling due to shaking of the supporting legs when placed on uneven ground, so that it is safer for the user to sit on the portable folding chair.

BRIEF DESCRIPTION OF DRAWINGS

To more clearly illustrate the technical solution in the embodiments of the present utility model or in the prior art, the drawings required to be used in the description of the embodiments or the prior art are briefly introduced below. The drawings in the following description are only the corresponding drawings of some embodiments of the present utility model.

DETAILED DESCRIPTION OF EMBODIMENTS

To make objectives, technical solutions, and advantages of embodiments of the present disclosure clearer, the following clearly and completely describes technical solutions in embodiments of the present disclosure with reference to accompanying drawings in embodiments of the present disclosure. It is clear that the described embodiments are merely some but not all of embodiments of the present disclosure. Based on the described embodiments of the present disclosure, all other embodiments obtained by those of ordinary skill in the art without creative efforts fall within the protection scope of the present disclosure.

Unless otherwise defined, the technical terms or scientific terms used herein shall have the ordinary meaning understood by those of ordinary skill in the art to which the present disclosure belongs.

The terms "first", "second", and the like used in the specification and claims of this patent application do not indicate any order, quantity, or importance, but rather are used to distinguish different components. The terms "comprises", "includes", or other similar terms mean that the elements or items listed before "comprises" or "includes" cover the elements or items and equivalents thereof listed after "comprises" or "includes", and other elements or items are not excluded. The terms "connection", "connect to", or other similar terms are not limited to physical or mechanical connections, but may include electrical connections, whether direct or indirect. The terms "upper", "lower", "left", "right", and the like are only used to indicate the relative positional relationship. When the absolute position of the described object changes, the relative positional relationship may also change accordingly.

The technical solutions in the embodiments of the present utility model will be clearly and completely described below with reference to the drawings in the embodiments of the present utility model. It is apparent that the described embodiments are only some, but not all, embodiments of the present utility model. Based on the embodiments of the present utility model, all other embodiments obtained by those skilled in the art without creative efforts fall within the protection scope of the present utility model.

The present utility model provides a preferred embodiment of a portable folding chair capable of solving the above technical problems.

Figure 1:
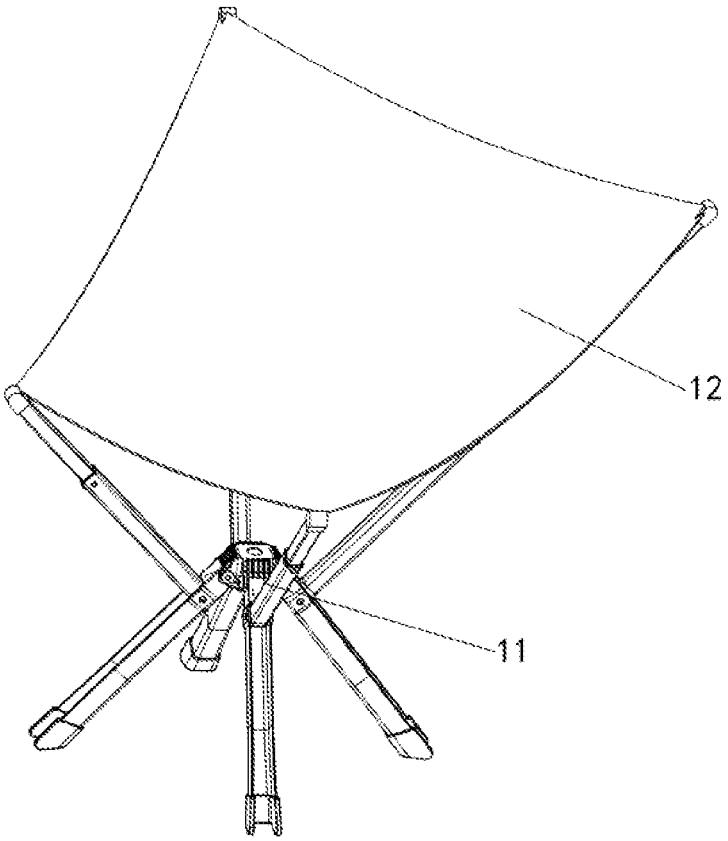
FIG. 1 is a perspective view of a portable folding chair according to the present utility model.
Figure 2:
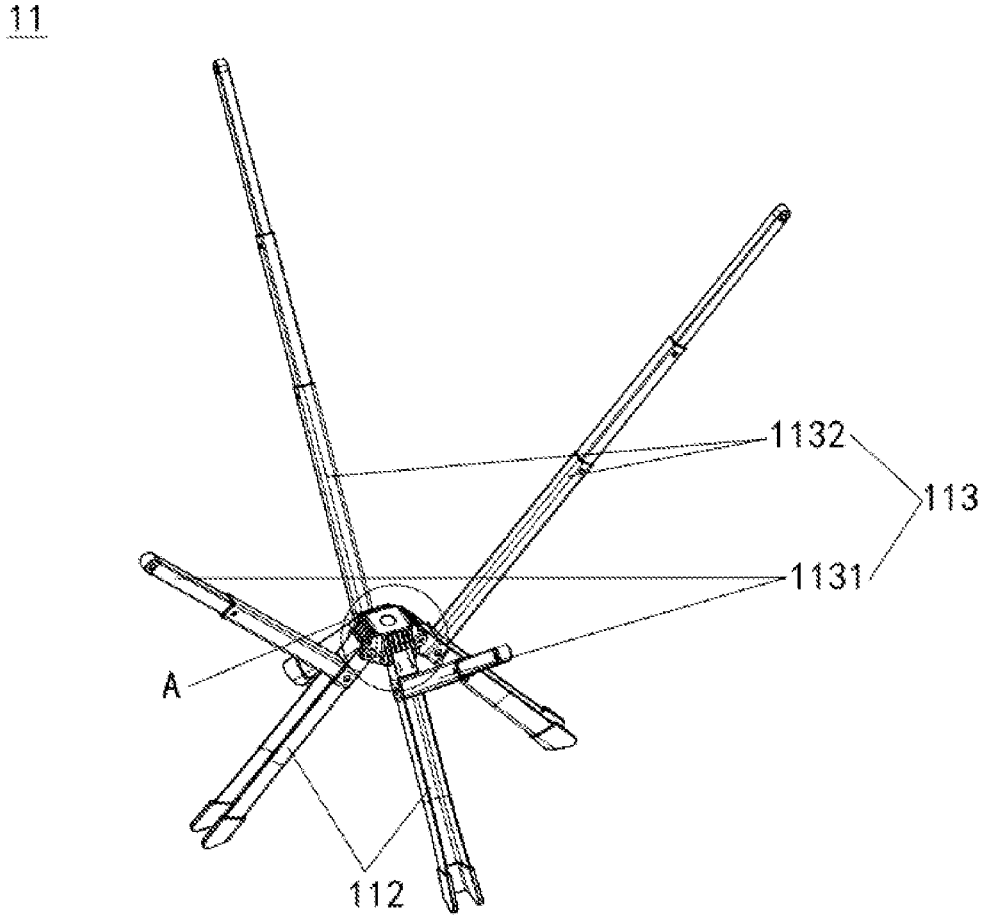
FIG. 2 is a perspective view of a supporting frame of a portable folding chair according to the present utility model.
Figure 3:
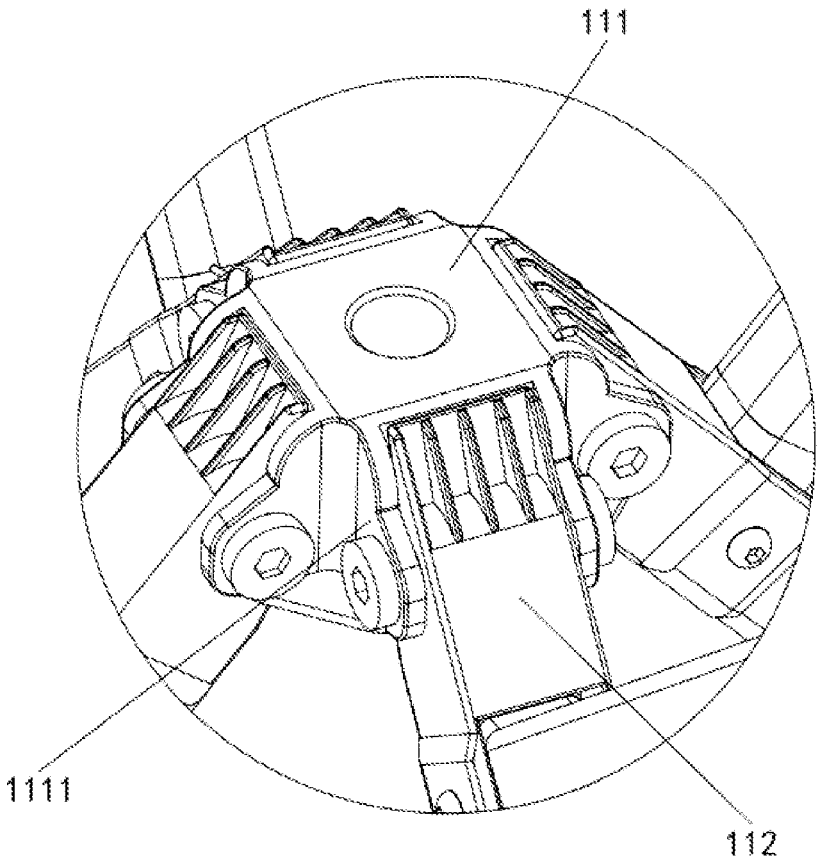
FIG. 3 is a partially enlarged view of a part A in FIG. 2.
Figure 4:
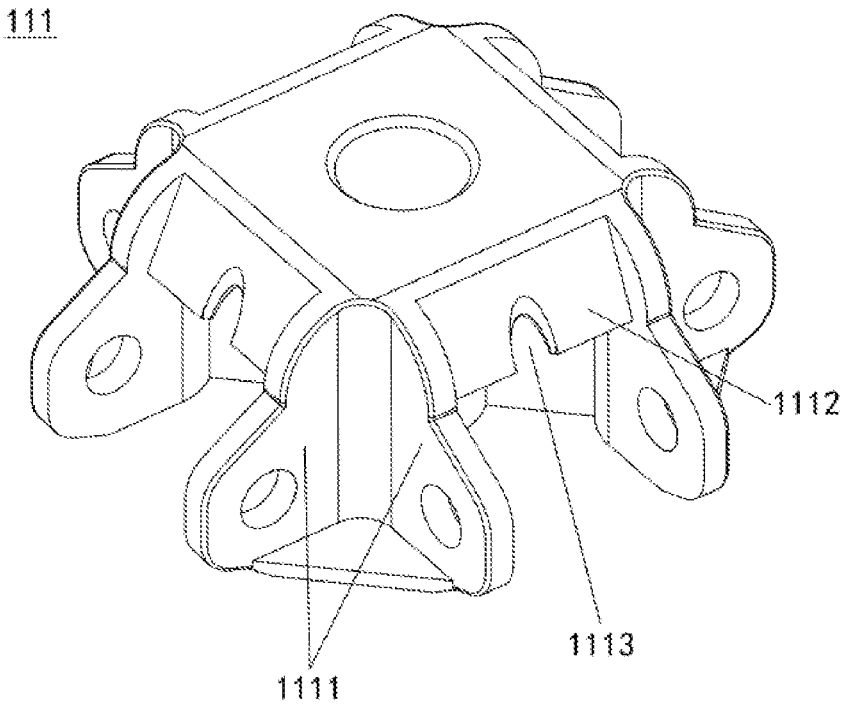
FIG. 4 is a perspective view of a fixed seat of a portable folding chair according to the present utility model.

Referring to FIG. 1, FIG. 2, FIG. 3, and FIG. 4, where FIG. 1 is a perspective view of a portable folding chair according to the present utility model, FIG. 2 is a perspective view of a supporting frame of a portable folding chair according to the present utility model, FIG. 3 is a partially enlarged view of a part A in FIG. 2, and FIG. 4 is a perspective view of a fixed seat of a portable folding chair according to the present utility model.

In the drawings, elements having similar structures are denoted by the same reference numerals.

In the present utility model, the terms "first", "second", and the like are merely intended for description, and shall not be interpreted as indicating or implying relative importance, nor as limiting the sequence.

The present utility model provides a portable folding chair, which comprises a supporting frame 11 and a cloth cover cushion 12 detachably connected to the supporting frame 11, wherein the supporting frame 11 comprises a fixed seat 111, a plurality of supporting legs 112 rotatably connected to the fixed seat 111 and a supporting assembly 113 rotatably connected to the supporting legs 112 and configured to support the cloth cover cushion 12, a plurality of limiting plates 1112 and lugs 1111 positioned at two sides of the limiting plates 1112 are provided on a periphery of the fixed seat 111, an accommodating groove 1118 for mounting the supporting leg 112 is formed between the limiting plate 1112 and the lug 1111, the supporting leg 112 is rotatably connected in the accommodating groove 1118, a front end of the supporting leg 112 is provided with a guide surface 1124 matched with the limiting plate 1112, when the supporting legs 112 are unfolded and connected to the fixed seat 111, the guide surface 1124 is attached to the limiting plate 1112, and two sides of the guide surface are separately attached to the lug 1111.

According to the portable folding chair of the present utility model, the supporting frame 11 is configured to support the cloth cover cushion 12, the cloth cover cushion 12 is configured to support the buttocks of a user, and the cloth cover cushion 12 is detachably connected to the supporting frame 11 and configured to facilitate the storage of the supporting frame 11, so that the space volume is reduced, and the portable folding chair is convenient to carry. The fixed seat 111 is configured to connect the supporting leg 112, the supporting leg 112 is configured to be unfolded on the ground so as to support the supporting assembly 113, the supporting assembly 113 is configured to support the cloth cover cushion 12, the front end of the supporting leg 112 is connected in the lug 1111, the supporting leg 112 is limited by two sides of the lug 1111 so as to prevent the supporting leg 112 from shaking when being connected to the fixed seat 111, and the limiting plate 1112 is configured to limit a rotating distance of the supporting leg 112 when being attached to the guide surface 1124; therefore, after the supporting leg 112 rotates to a set distance, the supporting assembly 113 is conveniently unfolded to mount the cloth cover cushion 12, and it is effectively guaranteed that the supporting legs 112 will not shake on the fixed seat 111 when the user sits on the portable folding chair and shakes. Meanwhile, when the portable folding chair is placed on uneven ground, the problem that the supporting leg 112 falls over due to shaking can be effectively solved, and a user can sit on the portable folding chair more safely.

In this embodiment, a strap (not shown) may be provided on the cloth cover cushion 12, and when the portable folding chair is stored, the cloth cover cushion 12 covers the supporting frame 11 and is fixed by the strap.

Figure 8:
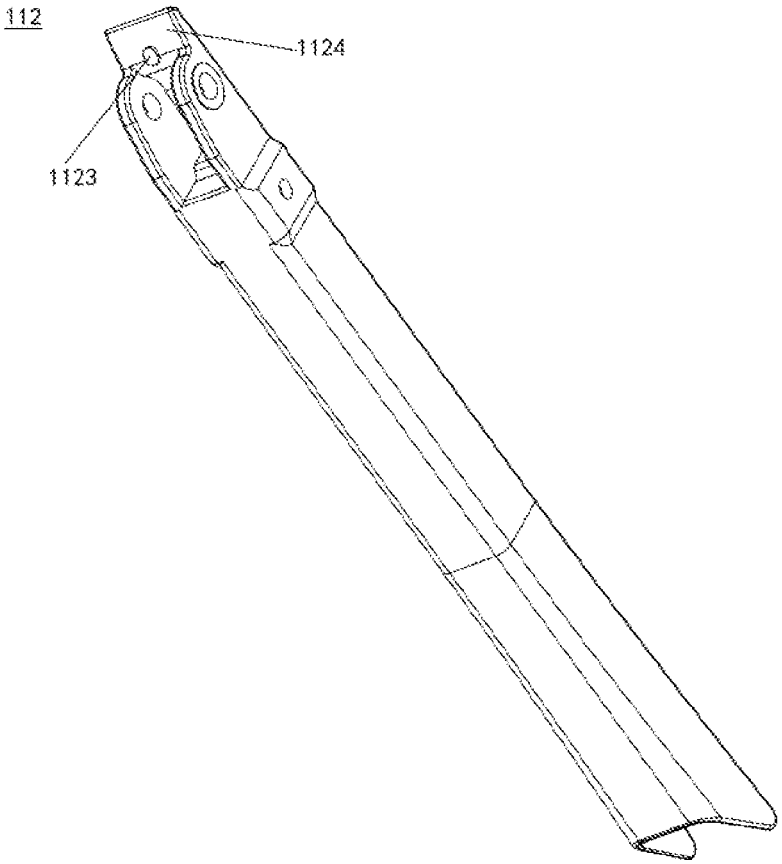
FIG. 8 is a perspective view of a supporting leg of a portable folding chair according to the present utility model.

Referring to FIG. 4 and FIG. 8, FIG. 8 is a perspective view of a supporting leg of a portable folding chair according to the present utility model, a positioning through hole 1113 is provided on the limiting plate 1112, wherein the positioning through hole 1113 is arranged at an outer edge of the limiting plate, a positioning protrusion 1123 is provided at a position that is of the supporting leg 112 and that is opposite to the positioning through hole 1113, the positioning protrusion 1123 is connected in the positioning through hole 1113, and the positioning through hole 1113 and the positioning protrusion 1123 cooperate to achieve guiding, so as to facilitate the unfolding of the supporting frame 112, so that the plurality of supporting legs 112 are unfolded on the fixed seat 111 at the same position, and the supporting leg 112 is prevented from being skewed when being connected to the fixed seat 111.

Figure 6:
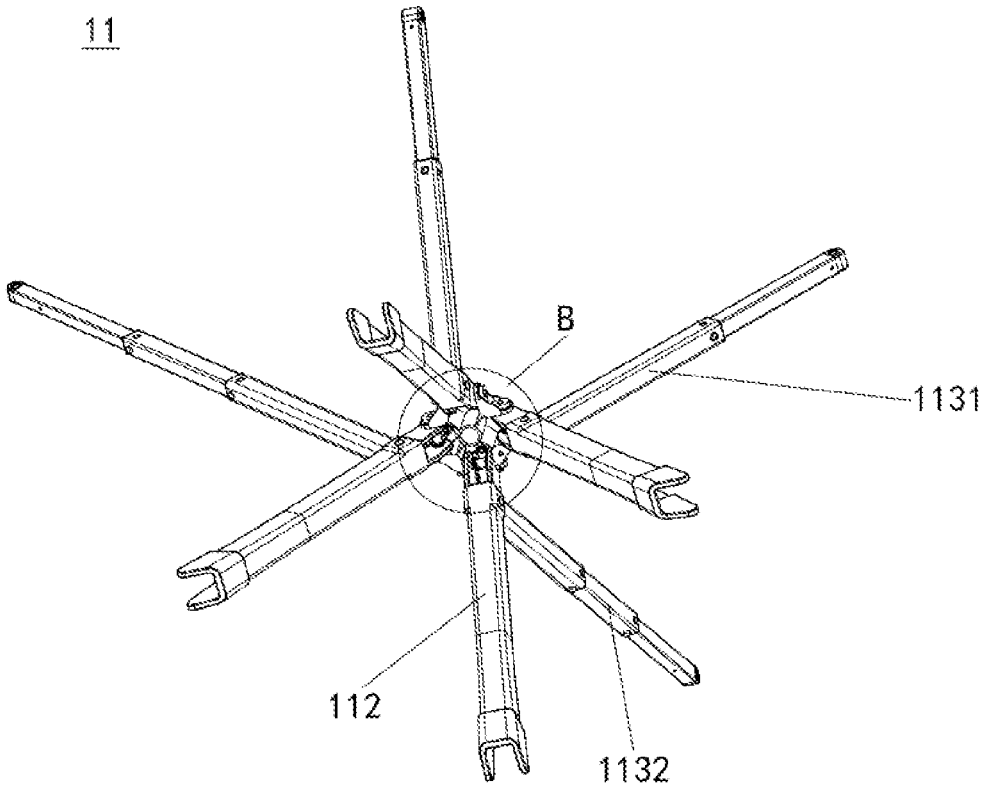
FIG. 6 is a perspective view of a supporting frame of a portable folding chair according to the present utility model.
Figure 7:
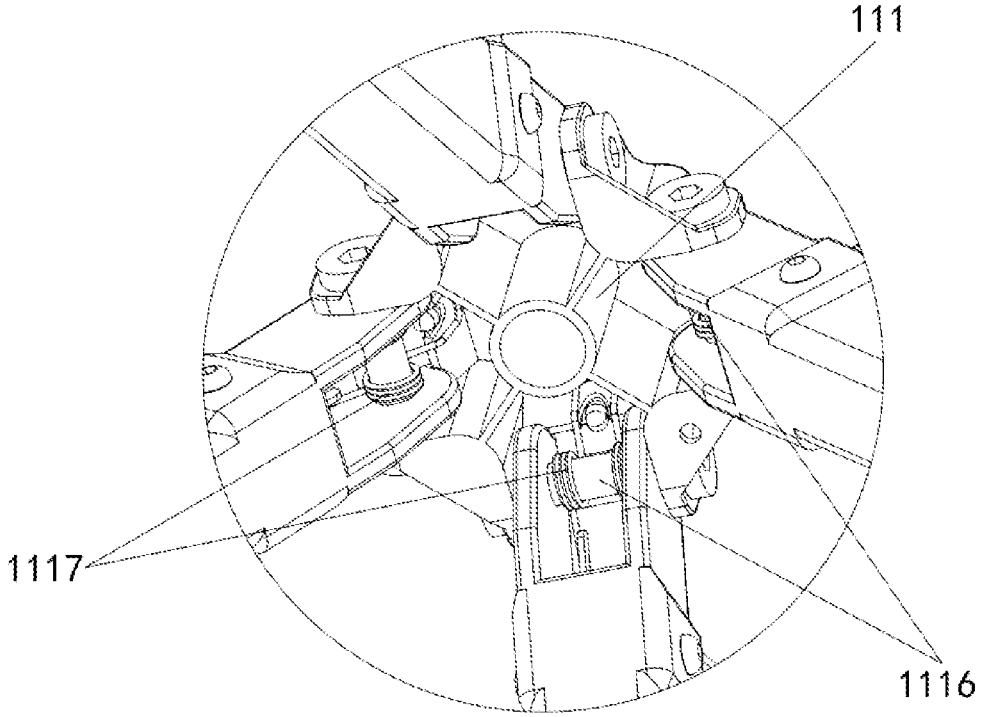
FIG. 7 is a partially enlarged view of a part B in FIG. 6.

Referring to FIG. 6 and FIG. 7, FIG. 6 is a perspective view of a supporting frame of a portable folding chair according to the present utility model, FIG. 7 is a partially enlarged view of a part B in FIG. 6, the fixed seat 111 is further provided with a first rotating shaft 1116 connected to the lug 1111, the supporting leg 112 is connected to the first rotating shaft 1116, a torsion spring 1117 is provided on the first rotating shaft 1116, two ends of the torsion spring 1117 are respectively connected to the supporting leg 112 and the limiting plate 1112, the first rotating shaft 1116 is configured to facilitate the rotation of the supporting leg 112 on the fixed seat 111, thereby facilitating the unfolding and storage of the supporting leg 112, and the torsion spring 1117 is configured to facilitate the supporting leg 112 to spring open on the fixed seat 111, thereby effectively improving the efficiency of the unfolding of the supporting leg 112 on the fixed seat 111.

In this embodiment, the limiting plate 1112 is arranged obliquely, and the guide surface 1124 at the front end of the supporting leg is an inclined surface matched with the limiting plate 1112, and the limiting plate 1112 is configured to limit an unfolding angle of the supporting leg 112 on the fixed seat 111, and is also configured to increase a height of the supporting frame 11 after unfolding, thus effectively increasing an overall height of the portable folding chair.

Figure 5:
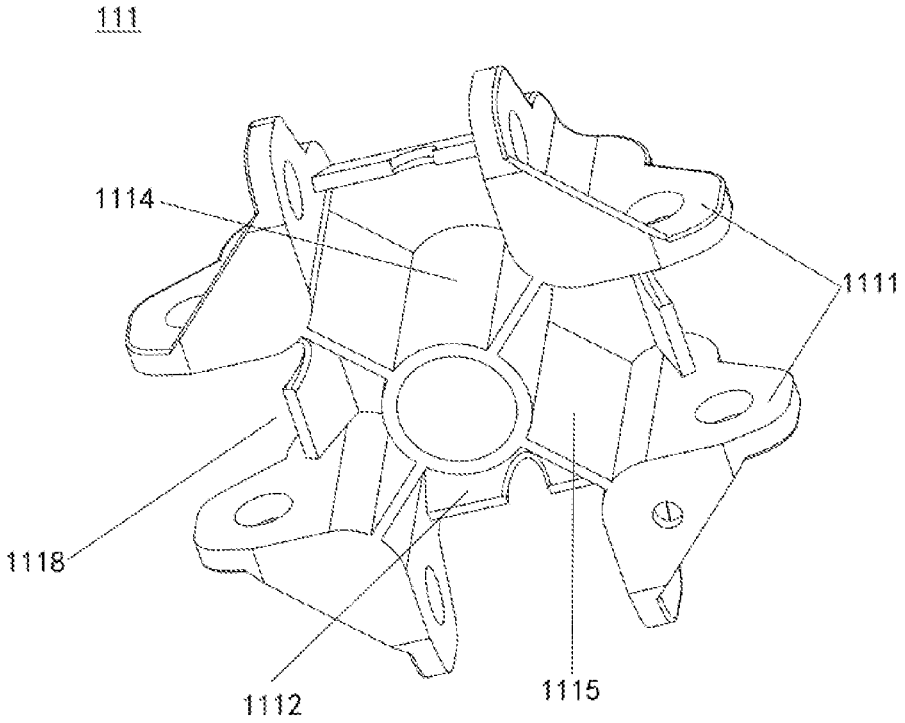
FIG. 5 is a perspective view of a fixed seat of a portable folding chair according to the present utility model.

Referring to FIG. 5, FIG. 5 is a perspective view of a fixed seat of a portable folding chair according to the present utility model, a cylinder 1114 that is hollow and passes through the fixed seat 111 is provided at a bottom of the fixed seat 111, and a periphery of the cylinder 1114 is provided with a plurality of reinforcing plates 1115 connected to a side wall of the fixed seat 111, the hollow cylinder 1114 is configured to reduce the weight of the fixed seat 111, and the reinforcing plates 1115 are configured to reinforce the stability of the fixed seat 111 and prevent the lugs 1111 from being skewed due to the gravity of the user.

The supporting assembly 113 comprises a plurality of first supporting rods 1131 and a plurality of second supporting rods 1132 rotatably that are separately connected to the supporting legs 112, the second supporting rod 1132 has a length greater than that of the first supporting rod 1131, the first supporting rod 1131 and the second supporting rod 1132 are both configured to mount the cloth cover cushion 12, and after the cloth cover cushion 12 is mount on the first supporting rod 1131 and the second supporting rod 1132, the cloth cover cushion 12 forms an arc shape, so as to conveniently support the buttocks of a user and the back of the user, so that the user can lie down on the portable folding chair in a relaxed manner.

In this embodiment, when the first supporting rod 1131 and the second supporting rod 1132 are in a contracted state, the cloth seat cushion 12 is in a relaxed state when connected to the first supporting rod 1131 and the second supporting rod 1132; and when the first supporting rod 1131 and the second supporting rod 1132 are in an unfolded state, the cloth cover cushion 12 is connected to the first supporting rod 1131 and the second supporting rod 1132 through tension and is in a tight state.

In this embodiment, the first supporting rod 1131 and the second supporting rod 1132 are both multi-section telescopic rods. Through stretching and clamping, the multi-section telescopic rods can telescopically extend the lengths of the first supporting rod 1131 or the second supporting rod 1132. After being pressed, the multi-section telescopic rods can be contracted, thereby reducing the lengths of the first supporting rod 1131 and the second supporting rod 1132.

Figure 9:
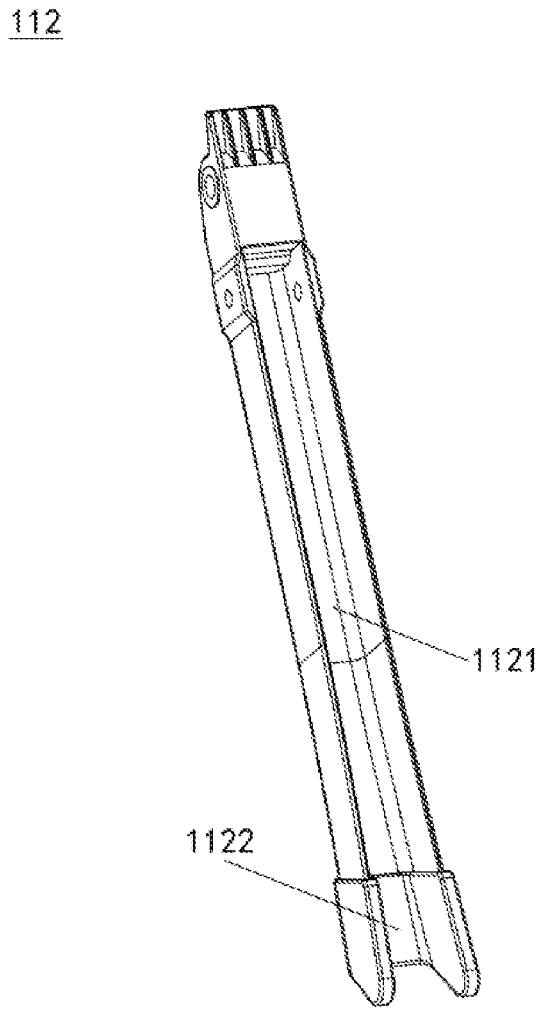
FIG. 9 is a perspective view of a supporting leg of a portable folding chair according to the present utility model.

Referring to FIG. 9, FIG. 9 is a perspective view of a supporting leg of a portable folding chair according to the present utility model, the first supporting rod 1131 and the second supporting rod 1132 are both telescopically arranged to facilitate the storage of the first supporting rod 1131 and the second supporting rod 1132. The through grooves 1121 for placing the first supporting rod 1131 and the second supporting rod 1132 are provided on a top surface of the supporting leg 112, and meanwhile, the stored first supporting rod 1131 and second supporting rod 1132 can be folded in the through grooves 1121 of the supporting leg 112, so as to further reduce the space volume of the supporting frame 11.

A bottom of the supporting leg 112 is provided with an anti-skid rubber sleeve 1122, and the anti-skid rubber sleeve 1122 is configured to prevent the supporting leg 112 from skidding on the ground.

The lug 1111 and the fixed seat 111 are integrally formed to enhance the strength of the connection between the lug 1111 and the fixed seat 111 and prevent the lug 1111 from being separated from the fixed seat 111.

Rationale:

When the portable folding chair is unfolded, firstly, the strap of the cloth cover cushion 12 are untied, and the cloth cover cushion 12 is loosened to unfold the supporting frame 11. Due to the action of the torsion spring 1117, the torsion spring 1117 unfolds the supporting leg 112 based on an elastic force, the supporting leg 112 rotates in the accommodating groove 1118 of the fixed seat 111 with the first rotating shaft 1116 as a rotation center, the positioning protrusion 1123 of the supporting leg 112 rotates in the positioning through hole 1113, and the positioning through hole 1113 limits the positioning protrusion 1123, so that the supporting leg 112 is prevented from position deviation during rotation. When the guide surface 1124 of the supporting leg 112 is attached to the limiting plate 1112, two sides of the supporting leg 112 are attached to the lug 1111, and therefore the supporting leg 112 is prevented from shaking on the fixed seat 111 after being unfolded. Further, the cloth cover cushion 12 is mounted on the first supporting rod 1131 and the second supporting rod 1132, the first supporting rod 1131 and the second supporting rod 1132 are separately pulled out from the through groove 1121 of the supporting leg 112, the first supporting rod 1131 and the second supporting rod 1132 are separately lengthened, and the cloth cover cushion 12 is tightened by a pulling force of the cloth cover cushion 12 to the first supporting rod 1131 and the second supporting rod 1132; when a user sits on the portable folding chair, since the positioning through hole 1113 limits the positioning protrusion 1123, the lug 1111 limits two sides of the supporting leg 112, and the limiting plate 1112 limits the guide surface 1124 of the supporting leg 112, the supporting leg 112 can be effectively prevented from shaking on the fixed seat 111; when a user shakes on the portable folding chair or the portable folding chair is placed on uneven ground, the problem that the portable folding chair falls over due to shaking of the supporting legs 112 can be effectively prevented, and the portable folding chair is more convenient to use.

When the portable folding chair according to this preferred embodiment is unfolded by the supporting legs 112, the guide surfaces 1124 of the supporting legs 112 are attached to the limiting plates 1112, and the limiting plates 1112 limit the supporting legs 112, so that the supporting legs 112 are prevented from being unfolded at an excessive angle; and in addition, after the limiting plates 1112 are attached to the guide surfaces 1124 of the supporting legs 112, two sides of the supporting legs 112 are attached to the lugs 1111, it is effectively guaranteed that the supporting legs 112 will not shake on the fixed seat when the portable folding chair is used by a user, and the portable folding chair is effectively prevented from falling due to shaking of the supporting legs when placed on uneven ground, so that it is safer for the user to sit on the portable folding chair.

In conclusion, although the present utility model has been disclosed above with preferred embodiments, the foregoing preferred embodiments are not intended to limit the present utility model, and those of ordinary skill in the art can make various changes and modifications without departing from the spirit and scope of the present utility model. Therefore, the protection scope of the present utility model shall be subject to the scope defined by the claims.

The invention claimed is:

1. A portable folding chair, comprising: a supporting frame and a cloth cover cushion detachably connected to the supporting frame, wherein the supporting frame comprises a fixed seat, a plurality of supporting legs rotatably connected to the fixed seat and a supporting assembly rotatably connected to the plurality of supporting legs and configured to support the cloth cover cushion; a plurality of limiting plates are provided on a periphery of the fixed seat, and a lug is positioned at each of two sides of each of the plurality of limiting plates;

for each of the plurality of supporting legs, which corresponds to one of the plurality of limiting plates:

an accommodating groove is formed for mounting the supporting leg and is enclosed by the limiting plate and the lugs on the two sides of the limiting plate, such that the supporting leg is rotatably connected in the accommodating groove;

a front end of the supporting leg is provided with a guide surface matched with the limiting plate; when the supporting leg is unfolded and connected to the fixed seat, the guide surface is attached to the limiting plate, and two sides of the guide surface are separately attached to the lugs on the two sides of the limiting plate;

a positioning through hole is provided on the limiting plate, a positioning protrusion is provided at a position that is of the supporting leg and that is opposite to the positioning through hole, and when the supporting frame is unfolded, the positioning protrusion is positioned in the positioning through hole.

2. The portable folding chair according to claim 1, wherein the fixed seat is further provided with a first rotating shaft connected to the lugs on the two sides of the limiting plate, and the supporting leg is connected to the first rotating shaft; and a torsion spring is provided on the first rotating shaft, and two ends of the torsion spring are respectively connected to the supporting leg and the limiting plate.

3. The portable folding chair according to claim 1, wherein the limiting plate is arranged obliquely relative to a direction perpendicular to a surface defined by the periphery of the fixed seat, and the guide surface is an inclined surface matched with the limiting plate.

4. The portable folding chair according to claim 1, wherein a cylinder that is hollow and passes through the fixed seat is provided at a bottom of the fixed seat, and a periphery of the cylinder is provided with a plurality of reinforcing plates connected to a side wall of the fixed seat.

5. The portable folding chair according to claim 1, wherein the supporting assembly comprises a plurality of first supporting rods and a plurality of second supporting rods that are rotatably connected and are separately connected to the plurality of supporting legs, and each of the plurality of second supporting rods has a length greater than that of each of the plurality of first supporting rods.

6. The portable folding chair according to claim 5, wherein each of the plurality of first supporting rods and each of the plurality of second supporting rods are both telescopically arranged.

7. The portable folding chair according to claim 6, wherein the plurality of supporting legs are provided with through grooves for placing the plurality of first supporting rods and the plurality of second supporting rods.

8. The portable folding chair according to claim 1, wherein a bottom of supporting leg is provided with an anti-skid rubber sleeve.

9. The portable folding chair according to claim 1, wherein the lugs and the fixed seat are integrally formed.

* * * * *